US007021195B2

(12) United States Patent
Proust

(10) Patent No.: US 7,021,195 B2
(45) Date of Patent: Apr. 4, 2006

(54) PRIMING PUMP

(75) Inventor: Nathalie Proust, Reims (FR)

(73) Assignee: Nobel Plastiques, (FR)

( * ) Notice: Subject to any disclaimer, the term of this patent is extended or adjusted under 35 U.S.C. 154(b) by 280 days.

(21) Appl. No.: 10/636,693

(22) Filed: Aug. 8, 2003

(65) Prior Publication Data

US 2004/0033143 A1 Feb. 19, 2004

(30) Foreign Application Priority Data

Aug. 13, 2002 (FR) ..... 02 10265

(51) Int. Cl.
*F01B 19/00* (2006.01)

(52) U.S. Cl. ..... 92/92; 92/103 R

(58) Field of Classification Search ..... 92/89, 92/90, 91, 92, 103 R; 123/179.9, 179.11; 417/478
See application file for complete search history.

(56) References Cited

U.S. PATENT DOCUMENTS

| | | | | |
|---|---|---|---|---|
| 523,345 | A * | 7/1894 | Hardman | 92/92 |
| 2,954,048 | A | 9/1960 | Rychlik | |
| 3,839,983 | A * | 10/1974 | McAusland | 417/478 |
| 3,987,775 | A | 10/1976 | O'Connor | |
| 4,886,432 | A * | 12/1989 | Kimberlin | 417/478 |
| 5,970,935 | A * | 10/1999 | Harvey et al. | 123/179.11 |

FOREIGN PATENT DOCUMENTS

| | | |
|---|---|---|
| FR | 2 703 403 | 10/1994 |
| GB | 684 598 | 12/1952 |
| WO | WO 94/10491 | 5/1994 |

* cited by examiner

*Primary Examiner*—Edward K. Look
*Assistant Examiner*—Michael Leslie
(74) *Attorney, Agent, or Firm*—Dykema Gossett PLLC

(57) ABSTRACT

The invention relates to a priming pump comprising an enclosure having an elastically deformable central zone connected to two coupling zones, the enclosure being comprising an outer layer of elastomer material and an inner layer of barrier-forming material against the fluid present inside the pump.

6 Claims, 1 Drawing Sheet

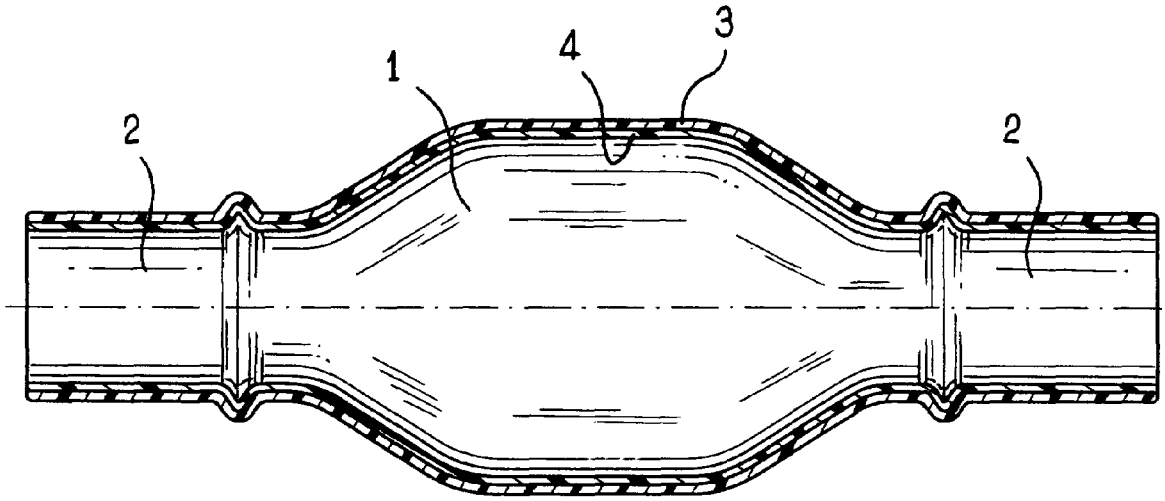
1
2
2
3
4

PRIMING PUMP

The invention relates to a priming pump designed, in particular, to be fitted to a fuel feed-circuit of a motor vehicle.

BACKGROUND OF THE INVENTION

Priming pumps are known that are made of elastomer and that present an enclosure having a central zone that is elastically deformable between a rest state, in which the enclosure has a maximum volume, and a pressed state. The enclosure includes coupling zones at the inlet and the outlet of the central zone, which include check valves that are arranged so as to enable fluid to pass in a determined direction each time the enclosure is pressed.

Recent motor-vehicle engines (in particular diesel engines having a common injector unit) have the characteristic of working at a high average temperature, it being possible for the fuel to be raised to 125° Celsius (C) on a continuous basis, for example, with peaks of up to 150° C.

In addition, in the feed circuits provided for that type of engine, the priming pumps can be mounted in parallel with the injection pump on the feed circuit and are no longer in series with said feed circuit, such that the inside of the priming pump no longer has fuel flowing therethrough but, on the contrary, contains stagnant fuel.

It should be observed that under such conditions, the materials currently used for making enclosures tend to age prematurely for various reasons.

Firstly, the acidity that the fuel acquires at high temperatures, combined with the high amplitude of the temperature variations, causes the enclosure to deteriorate prematurely.

Secondly, the additives contained in the recent fuels provided for that type of engine are particularly corrosive for the material of the enclosure, especially at high temperature.

Furthermore, the stagnant fuel infiltrates naturally into the pores of the material of the enclosure, thereby leaching out the fillers included in the material to give it its elasticity.

In order to make a priming pump enclosure that satisfies such constraints, consideration has been given to using a material of the fluoroelastomer type, which withstands both chemical and thermal attacks and retains its elasticity over time. However, in addition to that material being too costly for it to be envisaged for use in the context of mass production, it is also difficult to recycle.

OBJECT OF THE INVENTION

An object of the invention is to provide a priming pump that does not present the above-mentioned drawbacks.

BRIEF DESCRIPTION OF THE INVENTION

The invention provides a multilayer priming pump having an enclosure comprising an elastic outer layer of elastomer material and an inner layer forming a barrier against the fluid present inside the pump.

The inner layer prevents the fuel from penetrating into the elastomer of the outer layer or from reacting chemically with said elastomer.

Consequently, said outer layer can be made of a standard-type elastomer which, being subjected to temperature variations only, is capable of retaining its elastic properties over time.

The enclosure obtained in this way is certainly more costly than a single-layer of ordinary elastomer, but nevertheless remains much cheaper than a single-layer enclosure of fluoroelastomer. In addition, it is easier to recycle.

BRIEF DESCRIPTION OF THE DRAWING

Other characteristics and advantages of the invention appear from the following description of a particular, non-limiting embodiment of the invention, given with reference to the sole accompanying figure which shows a priming pump enclosure of the invention in longitudinal section.

DETAILED DESCRIPTION OF THE INVENTION

With reference to the figure, a priming pump enclosure includes, in manner known per se, a central zone 1 of large diameter that can be deformed by hand, the central zone being associated with two coupling zones 2 which extend on either side of said central zone and which contain check valves (not shown).

In the invention, the enclosure of the priming pump is multilayered and comprises an outer layer 3 and an inner layer 4.

In this case, the outer layer 3 is made of an ordinary-type elastomer, preferably a thermoplastic polyether-ester (TPEE), which enables good elasticity to be imparted to the central zone 1 of the enclosure, and which withstands large variations in temperature.

The inner layer 4 is itself preferably made out of the following materials:

- polyamide (PA);
- polyphenylene sulfone (PPS);
- a mixture of polyphenylene sulfone (PPS) and polyamide (PA);
- a mixture of polyamide (PA) and polyolefin (PO); and
- polybutylene terephthalate (PBT).

These materials form effective barriers against a wide variety of fuels, such as hydrocarbon-based or even alcohol-based or ester-based fuels.

Where applicable, an intermediate bonding layer can be provided between the outer layer 3 and the inner layer 4 so as to ensure good adhesion between the two layers.

In the invention, the above-mentioned materials for the inner layer 4 are generally less elastic than the material used for the outer layer 3, such that the thicknesses of the layers are capable of influencing the elasticity of the priming pump.

In the embodiment shown, the central zone 1 of the enclosure has a diameter of 40 mm, the minimum thicknesses of the inner and outer layers being 0.3 mm and 0.55 mm respectively, while the coupling zones 2 have a diameter of 21 mm, and the minimum thicknesses of the inner and outer layers are 0.55 mm and 0.85 mm respectively.

Numerous trials have been carried out which have resulted in the following dimensions:

- thickness of the inner layer: 0.1 mm to 1 mm; and
- thickness of the outer layer: 0.1 mm to 2 mm.

The local relative thickness of the inner layer preferably lies in the range 30% to 40% of the total local thickness of the enclosure.

This relative thickness range enables the enclosure to retain a satisfactory elasticity.

Such priming pumps can be obtained by coextruding the component layers of the pumps so as to form a multilayer tube, then forming the tube (e.g. by means of a device having moving molds placed at the outlet of the extruder) into a string of priming pumps, which then merely needs to be cut up.

What is claimed is:

1. A priming pump comprising an enclosure having an elastically deformable central zone connected to two coupling zones, wherein the enclosure comprises an outer layer of elastomer material and an inner layer of material bonded to said outer layer and forming a barrier against fluid present inside the pump.

2. A priming pump according to claim 1, wherein the enclosure further comprises an intermediate bonding layer between the outer layer and the inner layer.

3. A priming pump according to claim 1, wherein the inner layer is made out of one of the following materials:

polyamide;

polyphenylene sulfone;

a mixture of polyphenylene sulfone and polyamide;

a mixture of polyamide and polyolefin; and polybutylene terephthalate.

4. A priming pump according to claim 1, wherein the inner layer is of a thickness lying in the range of 0.1 mm to 1 mm.

5. A priming pump according to claim 1, wherein the outer layer is of a thickness lying in the range of 0.1 mm to 2 mm.

6. A priming pump according to claim 1, wherein the inner layer is of local relative thickness lying in the range 30% to 40% of the total thickness of the enclosure.

* * * * *